US006170270B1

(12) United States Patent
Arshansky et al.

(10) Patent No.: US 6,170,270 B1
(45) Date of Patent: Jan. 9, 2001

(54) REFRIGERATION SYSTEM USING LIQUID-TO-LIQUID HEAT TRANSFER FOR WARM LIQUID DEFROST

(75) Inventors: Yakov Arshansky, Conyers; David K. Hinde, Rex, both of GA (US)

(73) Assignee: Delaware Capital Formation, Inc., Wilmington, DE (US)

( * ) Notice: Under 35 U.S.C. 154(b), the term of this patent shall be extended for 0 days.

(21) Appl. No.: 09/239,877

(22) Filed: Jan. 29, 1999

(51) Int. Cl.[7] ..... F25D 21/12
(52) U.S. Cl. ..... 62/81; 62/277; 62/185
(58) Field of Search ..... 62/155, 151, 156, 62/81, 277, 278, 185, 509

(56) References Cited

U.S. PATENT DOCUMENTS

| | | | | |
|---|---|---|---|---|
| 2,657,546 | * | 11/1953 | Smith | 62/277 X |
| 4,646,539 | * | 3/1987 | Taylor | 62/278 |
| 5,727,393 | * | 3/1998 | Mahmoudzadeh | 62/81 |
| 5,921,092 | | 7/1999 | Behr et al. | 62/81 |

* cited by examiner

*Primary Examiner*—Harry B. Tanner
(74) *Attorney, Agent, or Firm*—Thomas, Kayden, Horstemeyer & Risley

(57) ABSTRACT

A warm liquid defrost refrigeration system (10) comprising a primary refrigeration loop (12) including a compressor (16), a condenser (18), an expansion device (22), and a first side of a chiller (24), and a secondary refrigeration loop (14) including a pump (26), a refrigerated space heat exchanger (28), and a second side of the chiller. The refrigeration system further includes a defrost heat exchanger (40) having a hot side and a cold side. The hot side of the defrost heat exchanger is connected to the primary refrigeration loop between the condenser and the expansion device such that liquid refrigerant can flow from the condenser through the hot side of the defrost heat exchanger. The cold side of the defrost heat exchanger is connected to the secondary refrigeration loop at a point downstream of the pump such that coolant can be selectively transported from the pump through the cold side of the defrost heat exchanger. The cold side of said defrost heat exchanger is also connected to the refrigerated space heat exchanger such that it can be selectively used to transport the heated coolant to the refrigerated space heat exchanger for defrost.

25 Claims, 2 Drawing Sheets

REFRIGERATION SYSTEM USING LIQUID-TO-LIQUID HEAT TRANSFER FOR WARM LIQUID DEFROST

FIELD OF THE INVENTION

The invention relates generally to a refrigeration system that uses a warm liquid defrost cycle. More particularly, the invention relates to a refrigeration system that uses liquid-to-liquid heat transfer to heat the coolant that will be used for the warm liquid defrost cycle.

BACKGROUND OF THE INVENTION

Present day food stores such as supermarkets and convenience stores typically use relatively high capacity refrigeration systems to keep their refrigerated and frozen food products cold. The two most common types of refrigeration systems may be generally designated as direct expansion systems and secondary coolant systems. In direct expansion systems, a two-phase, vapor-compression refrigeration loop is used which normally includes an evaporator positioned inside the refrigerated space that absorbs heat from the space, thereby cooling the space to the desired temperature. In secondary coolant systems, a primary refrigeration loop and a secondary refrigeration loop are used in conjunction to cool the refrigerated space. The primary loop of the system is typically a vapor-compression system similar to that used in direct expansion systems and usually comprises a compressor, condenser, receiver, and an expansion device. The secondary loop is typically a single-phase system and comprises a pump and a heat exchanger that is disposed within the refrigerated space to absorb heat therefrom. The two loops of secondary coolant systems thermally communicate with each other through a chiller which provides for heat transfer between the primary and secondary loops.

Currently, there is a trend toward use of secondary coolant systems rather than direct expansion systems in that the amounts of primary refrigerant used in the refrigerated space can be minimized when a secondary coolant system is used, increasing safety to personnel and customers that interact with the refrigerated space. In addition, secondary coolant systems provide the advantage of improving temperature stability and humidity within the refrigerated space.

As is well known in the art, moisture contained within the refrigerated space condenses on the heat exchanger used in the refrigerated space and freezes thereon to form frost. This frost greatly decreases the cooling efficiency of the refrigeration system and, if left to accumulate, can even block the flow of air through the evaporator or heat exchanger to diminish the heat exchange capacity of the refrigeration system. Several methods of removing this frost, known as defrosting, have been developed in the refrigeration arts. The simplest method is so called "off-cycle" defrost in which the refrigeration cycle is simply discontinued and the heat of the surrounding air meets the frost. In another method, the evaporator or heat exchanger is electrically heated to melt the frost. In direct expansion systems, typically the hot gas of the refrigerant discharged by the compressor is used to melt the frost. In yet another method, the secondary coolant system is defrosted by passing warm coolant through the refrigerated space heat exchanger for a predetermined period of time and/or temperature, so that the frost formed thereon melts and drains away. Of these several methods, liquid defrost is generally preferred in the art for several reasons. First, warm liquid defrost is safer than electrical and hot gas defrost in that it is less stressful on the refrigeration system. In addition, warm liquid defrost is more efficient than electrical and hot gas defrost and therefore does not result in a large degree of warming of the refrigerated space. This avoids food spoilage and also increases system efficiency in that a large degree of cooling is not necessary to bring the refrigerated space back to its standard operating temperature.

The most common methods of heating the liquid supplied to the coils located in the refrigeration space typically utilize the hot gas of the refrigeration system that is discharged by compressor. In particular, the hot gas from the compressor is diverted to a gas-to-liquid heat exchanger, often referred to as a heat reclamation tank, in fluid communication with the secondary coolant in which the coolant is heated so it then can be delivered to the refrigerated space heat exchanger.

Although typically providing enough heat energy to adequately defrost the coils of the refrigerated space evaporator or heat exchanger, usage of gas-to-liquid heat exchange presents several disadvantages. Specifically, gas has a relatively low coefficient of heat transfer in comparison to liquid. Due to this relatively low coefficient of heat transfer, the defrost liquid often must be prepared in advance of the defrost cycle to ensure adequate heating of the refrigeration space coils. Accordingly, defrost in many systems cannot be had "on demand." Moreover, the relatively low coefficient of heat transfer of the gas mandates relatively large heat transfer surface areas between the gas side and the liquid side of the heat reclamation tank or other heat exchanger. To provide this large heat transfer surface area, the heat reclamation tank or other heat exchanger typically must be large in size and, consequently, is quite expensive. Additionally, usage of heat reclamation tanks often requires the usage of other expensive equipment such as valves and control systems which are used to control operation of the reclamation tank.

From the above, it can be appreciated that it would be desirable to have a refrigeration system which utilizes warm liquid defrosting of the refrigerated space coils which is not dependent upon the hot discharge gas from the compressor and gas-to-liquid heat exchange.

SUMMARY OF THE INVENTION

Briefly described, the present invention comprises a warm liquid defrost refrigeration system comprising a primary refrigeration loop including a compressor, a condenser, an expansion device, and a first side of a chiller, and secondary refrigeration loop including a pump, a refrigerated space heat exchanger, and a second side of the chiller. In that both the primary refrigeration loop and the secondary refrigeration loop connect to the chiller, the primary and secondary refrigeration loops are in thermal communication with each other.

The refrigeration system further includes a defrost heat exchanger having a hot side and a cold side. The hot side of the defrost heat exchanger is connected to the primary refrigeration loop between the condenser and the expansion device such that liquid refrigerant can flow from the condenser or receiver through the hot side of the defrost heat exchanger. The cold side of the defrost heat exchanger is connected to the secondary refrigeration loop at a point downstream of the pump such that coolant can be selectively transported from the pump through the cold side of the defrost heat exchanger. The cold side of the defrost heat exchanger is also connected to the refrigerated space heat exchanger such that the cold side of the defrost heat exchanger can be selectively placed in fluid communication with the refrigerated space heat exchanger during defrost cycles.

When a defrost cycle is operated, coolant from the secondary refrigeration system flows through the cold side of the defrost heat exchanger, is heated by the liquid refrigerant flowing through the hot side of the defrost heat exchanger, and then is transported to the refrigerated space heat exchanger to melt any frost formed on the refrigerated space heat exchanger. Operating in this manner, the refrigeration system presents many advantages over conventional refrigeration systems in use today. In particular, the liquid-to-liquid heat transfer provided by the defrost heat exchanger saves space and decreases cost of the refrigeration system by reducing the heat transfer surface area needed to heat the coolant for defrost and by sub-cooling the liquid refrigerant before expansion in the primary loop.

The objects, features, and advantages of this invention will become more apparent upon reading the following specification, when taken in conjunction with the accompanying drawings. It is intended that all such additional features and advantages be included therein with the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
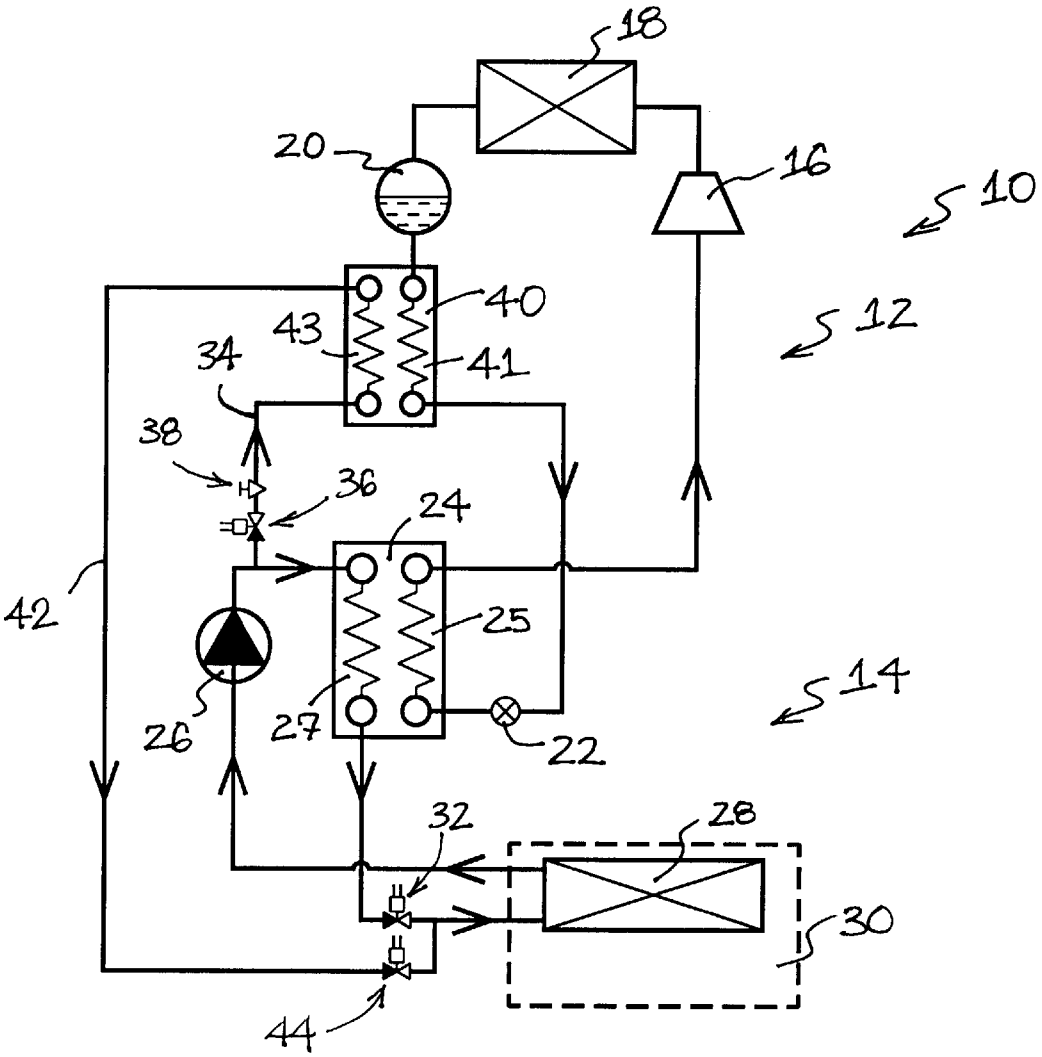
FIG. 1 is a schematic view of a first embodiment of a refrigeration system constructed in accordance to the present invention.
Figure 2:
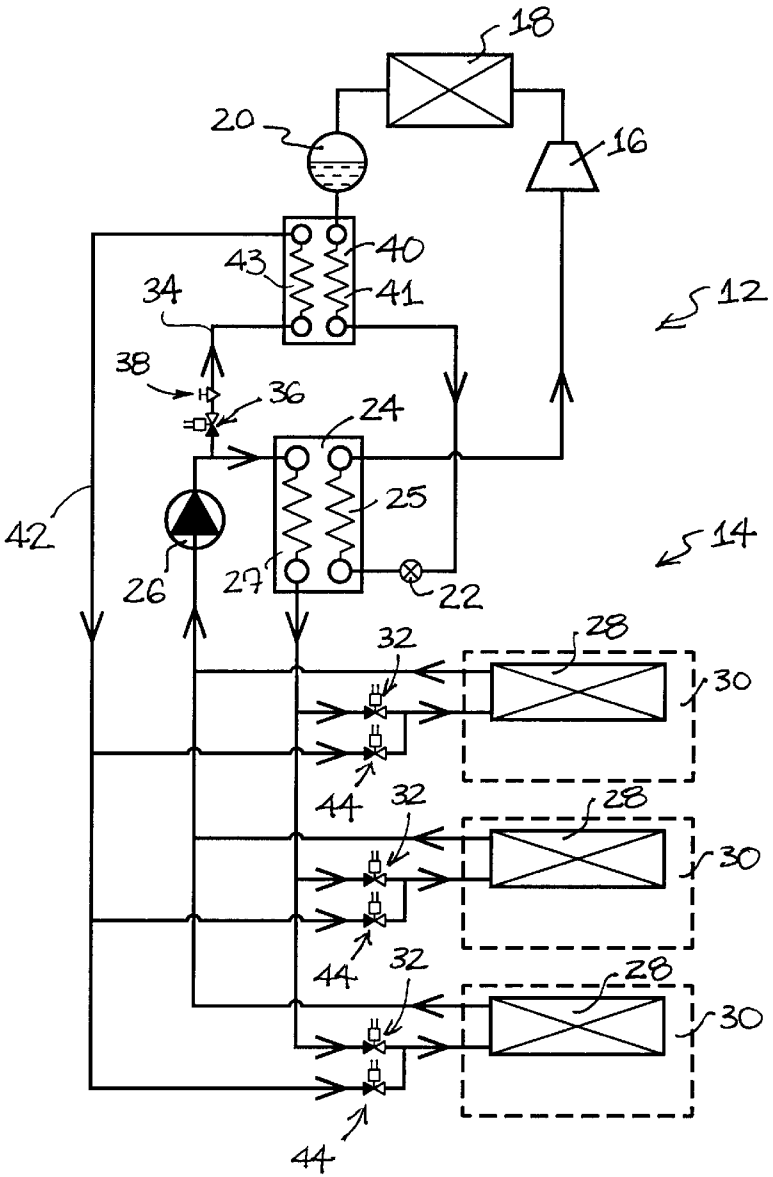
FIG. 2 is a schematic view of a second embodiment of a refrigeration system constructed in accordance to the present invention.

Referring now in more detail to the drawings, in which like numerals indicate like parts throughout the several views, FIGS. 1 and 2 illustrate refrigeration systems constructed in accordance to the present invention.

FIG. 1 illustrates, in schematic view, a first embodiment of a refrigeration system 10. As indicated in this figure, the refrigeration system is constructed as a secondary coolant system comprising a primary refrigeration loop or primary loop 12 and a secondary refrigeration loop or secondary loop 14 that are in thermal communication with each other. The primary loop typically is formed as a two-phase, vapor-compression loop and therefore normally comprises a compressor 16, a condenser 18, a receiver 20, and an expansion device 22. As is known in the art, the compressor 16 receives gas refrigerant circulating in the system and compresses it, increasing the pressure and temperature of the gas. Although depicted as a single compressor 16, it will be understood by those having ordinary skill in the art that several compressors arranged in series and/or parallel could be used depending upon the specific refrigeration requirements of the installation site.

The condenser 18 receives the high pressure, high temperature gas refrigerant from the compressor 16 and removes heat therefrom at a generally constant pressure until the gas refrigerant condenses into a saturated liquid which is collected in the receiver 20. Positioned downstream from the receiver 20 is a defrost heat exchanger 40. Although a detailed description of the configuration and function of the defrost heat exchanger is reserved for below, it suffices to say that this heat exchanger preferably takes the form of a plate heat exchanger having a hot side and a cold side. The expansion device 22 can take any one of a variety of forms including a thermal expansion valve, electric expansion valve, hand expansion valve, capillary tube, or other means for expanding the refrigerant. Positioned between the expansion device 22 and the compressor 16 in the primary loop 12 is a chiller 24. As is discussed in more detail below, the chiller includes a first side 25 in fluid communication with the primary loop 12 and a second side 27 in fluid communication with the secondary loop 14 such that the primary loop and the secondary loop are in thermal communication with each other.

The secondary loop 14 typically is formed as a single-phase loop that comprises a pump 26 which propels the coolant through the secondary loop and a refrigerated space heat exchanger 28 that is disposed within the refrigerated space 30. Although a single pump 26 is shown in the figure, it is to be understood that several pumps could be used in series and/or parallel to circulate the coolant through the secondary loop. Similarly, the refrigerated space heat exchanger 28 can take one of many forms. Irrespective of the type of heat exchanger used, the refrigerated space heat exchanger usually comprises one or more coils having a plurality of fins (not shown) which increase heat transfer from the refrigerated space to the coils and the coolant flowing therethrough. Air typically is forced across the fins of the coils, for example, by electric fans (not shown) to further increase the absorption of heat from the refrigerated space. The refrigerated space 30 can be any space which is to be cooled such as one or more freezer rooms, freezer cases, refrigerated display cases, and the like. Although only one refrigerated space is shown in FIG. 1, several such refrigerated spaces 30 can be cooled as indicated in FIG. 2.

The chiller 24 preferably is formed as a plate heat exchanger in which the first side 25 and the second side 27 of the chiller are arranged as alternating spaces formed between the plates of the chiller. Arranged in this manner, the first and second sides of the chiller thermally communicate such that heat from the secondary loop 14 is transferred to the primary loop 13 of the system. Typically positioned along the secondary loop between the chiller 24 and the refrigerated space heat exchanger 28 is a coolant shut-off valve 32. As is described below, the coolant shut-off valve serves to stop the flow of low temperature coolant to the refrigerated space heat exchanger 28 during a defrost cycle. Where more than one refrigerated space 30 is used, as shown in FIG. 2, one shut-off valve 32 is used for each refrigerated space so that the refrigerated spaces can be alternately defrosted without shutting down cooling of the other refrigerated spaces.

As is evident from FIG. 1, the refrigeration system 10 also comprises a coolant supply line 34 that is connected to the secondary loop 14 at a point downstream of the pump 26. This supply line includes a diverter valve 36 which can be opened and closed to selectively operate the defrost cycle described in detail below. Normally, the diverter valve 36 takes the form of a solenoid valve which is electrically actuated by a microprocessor driven control system (not shown). In addition to the diverter valve 36, the coolant supply line 34 normally is provided with a balance valve 38 which, as is discussed below, helps maintain the balance of the flow of coolant through the coolant supply line during defrost cycles.

The coolant supply line 34 connects the secondary loop 14 to the defrost heat exchanger 40. As indicated in FIG. 1, the defrost heat exchanger is connected to both the primary loop 12 and the secondary loop 14 of the system. With regard to the primary loop, the defrost heat exchanger 40 is positioned between the receiver 20 and the expansion device 22. With regard to the secondary loop, the defrost heat exchanger 40 is positioned between the pump 26 and the refrigerated space heat exchanger 28. Similar to the chiller 24, the defrost heat exchanger 40 typically takes the form of a plate heat exchanger having hot (primary loop) and cold (secondary loop) sides 41 and 43 that are arranged as alternating spaces formed between the plates of the heat exchanger.

The defrost heat exchanger 40 provides for heat transfer between the primary loop and the secondary loop during defrost cycles. When a defrost cycle is operated, low temperature coolant propelled by the pump 26 flows through the cold side of the heat exchanger 40 while high temperature liquid refrigerant supplied by the receiver 20 flows through the hot side 41 of the heat exchanger. Through the heat exchange between these two liquids, heat is transferred from the primary loop refrigerant to the secondary loop coolant to both warm the coolant for supply to the refrigerated space heat exchanger 28 for defrost, and to sub-cool the refrigerant flowing through the primary loop to the expansion device 22. Typically, the warm coolant is supplied to the refrigerated space heat exchanger through a warm liquid supply line 42. This supply line usually includes a warm liquid supply valve 44 which is used to open the flow of warm coolant to the refrigerated space heat exchanger 28 during the defrost cycle.

Operation

The primary components of the refrigeration system having been described above, the operation of the refrigeration system will now be discussed. It is to be noted that the specific temperature ranges, equipment, refrigerants, and coolants mentioned herein are provided for purposes of example only. Those having ordinary skill in the art will appreciate that alternative temperature ranges, equipment, refrigerants, and coolants may be used depending upon the particular application in which the refrigeration system is to be used.

The primary loop 12 is charged with a refrigerant such as a hydrochlorofluorocarbon ("HCFC"), a hydrofluorocarbon ("HFC"), or ammonia. When the system is operating, this refrigerant circulates through the system, changing phase from a liquid to a gas and back to a liquid again on a continual basis. Starting from a point upstream of the compressor 16, low pressure, superheated refrigerant vapor at a temperature of approximately −25° F. to 65° F. enters the compressor and is compressed therein such that, when discharged from the compressor, the pressure and temperature of the gas has increased substantially. Normally, the discharge gas has a temperature of approximately 100° F. to 250° F. depending upon the particular compressor arrangement used. The high pressure, high temperature gas refrigerant then passes into the condenser 18. Inside the condenser, heat energy contained in the gas refrigerant is removed at a generally constant pressure until the refrigerant becomes a saturated liquid. This saturated liquid typically has a temperature of approximately 50° F. to 115° F. and collects in the receiver 20 before passing through the defrost heat exchanger 40. When the refrigeration system is not in a defrost cycle, little or no heat exchange occurs in the defrost heat exchanger.

After passing through the defrost heat exchanger 40, the liquid refrigerant enters the expansion device 22, typically a thermostatic expansion valve. Upon exiting the expansion device, the refrigerant is in the form of a low pressure gas/liquid mixture. Because of the change of phase of most of the refrigerant from liquid to gas, the temperature of the gas/liquid mixture will normally be in the range of approximately −25° F. to 30° F. The gas/liquid mixture then passes into the first side of the chiller 24 where it absorbs heat from the coolant flowing through the second side of the chiller and is vaporized to assume the low pressure, saturated gas state found upstream of the compressor 16.

Turning to the secondary loop 14, the secondary loop is charged with a coolant such as a propylene glycol/water mixture or a Pekasol 50®/water mixture. Starting from a point upstream from the pump 26, relatively low pressure coolant at a temperature of approximately −25° F. to 30° F. enters the pump which propels the coolant through the second side 27 of the chiller 24. As described above, heat is removed from the coolant through heat exchange with the refrigerant flowing through the first side 25 of the chiller. Typically, the amount of heat exchange is relatively small, the coolant typically dropping in temperature approximately 5° F. to 10° F. after passing through the chiller 24. Next, the coolant flows through the refrigerated space heat exchanger 28. As described above, this heat exchanger typically comprises at least one finned coil (not shown) over which air is typically forced to increase absorption of heat from the refrigerated space 30.

After the system has been running in the aforementioned manner for a period of time, frost begins to build on the refrigerated space heat exchanger coils. To remove this frost, the refrigeration system switches over to a defrost cycle in which warm liquid (coolant) is provided to the refrigerated space heat exchanger 28 to melt the frost so that it can be drained away. Although capable of alternative configurations, the refrigerated system typically includes a microprocessor which controls the refrigeration system such that defrost cycles automatically will be conducted on a pre-programmed schedule. Depending upon the particular arrangement of the system, each refrigerated space will normally run approximately one to six defrost cycles per day of use. It is to be noted that, although the refrigerated system is described as including a microprocessor control system, manually or otherwise activated defrost cycles are not outside the purview of the present invention.

When a defrost cycle is initiated, coolant is permitted to flow from pump 26 through the coolant supply line 34 by opening the diverter valve 36 and the warm liquid supply valve 44. As described above, a microprocessor (not shown) typically controls the actuation of these valves based upon a pre-programmed sequence. Once the diverter valve and the warm liquid supply valve are opened, the coolant flows through the coolant supply line 34 to the cold side 43 of the defrost heat exchanger 40 where it is heated to a temperature of approximately 45° F. to 90° F. depending upon the configuration of the particular refrigeration system. During this time, the balance valve 38 serves to reduce the flow through the supply line to ensure proper heating of the coolant and soften the impact of this heating on the remainder of the system. The heated coolant then flows through the warm liquid supply line 42 and through the opened warm liquid supply valve 44 so that the warm coolant can flow through the coils of the refrigerated space heat exchanger 28 to melt any frost formed thereon. After a predetermined amount of time has passed, typically between five to seven minutes, the diverter valve 36 and the warm liquid supply valve 44 are closed and normal operation of the system is resumed.

The refrigeration system described above presents many advantages over conventional refrigeration systems in current use today. In particular, it is the liquid-to-liquid heat transfer which occurs in the defrost heat exchanger which provides the most significant advantages. Liquid-to-liquid heat transfer for warm liquid defrost greatly increases the efficiency of the refrigeration system. As noted above, liquid has a significantly higher coefficient of heat transfer in comparison to gas. By using the hot, saturated liquid refrigerant from the primary loop receiver to heat the secondary loop coolant instead of hot discharge gas from the primary loop compressor, the heat transfer surface area needed to heat the coolant for defrost is significantly reduced. Moreover, advance heating of the coolant in preparation for defrost is unnecessary, removing the need for a large, expensive heat reclamation tank and the other equipment typically used therewith. Since advance heating is not needed, defrost therefore can be had on demand. Furthermore, in that heat is transferred from the refrigerant passing through the hot side of the defrost heat exchanger to the coolant flowing through the cold side of the defrost heat exchanger, the refrigerant is sub-cooled to a temperature of approximately 15° F. to 90° F. This sub-cooling substantially increases the cooling capacity of the system in that the liquid refrigerant entering the expansion valve is already at a relatively low temperature. The cost savings represented by this sub-cooling can be significant given that the refrigeration system typically runs many defrost cycles a day. For example, depending upon the particulars of the refrigeration system and the installation site in which it operates, each 10° F. of sub-cooling provided to the refrigerant before expansion can yield an operation cost savings of approximately 6 per cent.

FIG. 2 illustrates the system of FIG. 1 as it applies to multiple heat exchangers 28 in refrigerated spaces 30. The heat exchangers 28 are arranged in parallel and are individually controlled by valves 32 and 42, which can operate simultaneously or in sequence, as programmed.

While preferred embodiments of the invention have been disclosed in detail in the foregoing description and drawings, it will be understood by those skilled in the art that variations and modifications thereof can be made without departing from the spirit and scope of the invention as set forth in the following claims.

What is claimed is:

1. A warm liquid defrost refrigeration system comprising:

a primary refrigeration loop including in sequence a compressor, a condenser, a receiver, an expansion device, and a first side of a chiller;

a secondary refrigeration loop including a pump, a second side of said chiller, and a refrigerated space heat exchanger wherein said secondary refrigeration loop is in thermal communication with said primary refrigeration loop through said chiller; and a defrost heat exchanger having a hot side and a cold side, said hot side of said defrost heat exchanger being connected to said primary refrigeration loop between said receiver and said expansion device such that liquid refrigerant can flow from said receiver through said hot side of said defrost heat exchanger, said cold side of said defrost heat exchanger being connected to said secondary refrigeration loop such that coolant can be selectively transported from said secondary refrigeration loop through said cold side of said defrost heat exchanger, said cold side of said defrost heat exchanger further being selectively, fluidly communicable with said refrigerated space heat exchanger;

wherein when a defrost cycle is operated, coolant from the secondary refrigeration loop flows through said cold side of said defrost heat exchanger, is heated by the liquid refrigerant flowing through said hot side of said defrost heat exchanger, and then is transported to said refrigerated space heat exchanger to melt any frost formed on said refrigerated space heat exchanger.

2. The refrigeration system of claim 1, wherein said secondary refrigeration loop connects to said cold side of said defrost heat exchanger through a coolant supply line.

3. The refrigeration system of claim 2, wherein said coolant supply line includes a diverter valve which can be opened or closed to selectively control the supply of coolant to said defrost heat exchanger.

4. The refrigeration system of claim 1, wherein said cold side of said defrost heat exchanger connects to said refrigerated space heat exchanger through a warm liquid supply line.

5. The refrigeration system of claim 4, wherein said warm liquid supply line includes a warm liquid supply valve which can be opened or closed to selectively control the supply of warm coolant to said refrigerated space heat exchanger.

6. The refrigeration system of claim 1, wherein said secondary refrigeration loop includes a coolant shut-off valve positioned between said chiller and said refrigerated space heat exchanger for stopping the flow of coolant to said refrigerated space heat exchanger during the defrost cycle.

7. The refrigeration system of claim 1, further comprising control means for controlling the initiation and termination of the defrost cycle.

8. The refrigeration system of claim 7, wherein said control means comprises a microprocessor which automatically initiates and terminates the defrost cycle according to a pre-programmed schedule.

9. The refrigeration system of claim 1, wherein said defrost heat exchanger is a plate heat exchanger.

10. A warm liquid defrost refrigeration system comprising:

a primary refrigeration loop including a compressor, a condenser, a receiver an expansion device, and a first side of a chiller;

a secondary refrigeration loop including a pump, a second side of said chiller, and a refrigerated space heat exchanger, wherein said secondary refrigeration loop is in thermal communication with said primary refrigeration loop through said chiller;

a defrost heat exchanger having a hot side and a cold side, said hot side of said defrost heat exchanger being connected to said primary refrigeration loop between said receiver and said expansion device such that liquid refrigerant can flow from said receiver through said hot side of said defrost heat exchanger;

a coolant supply line having first and second ends, said first end of said coolant supply line being connected to said secondary refrigeration loop at a point downstream of said pump and said second end of said coolant supply line being connected to said cold side of said defrost heat exchanger; and a warm liquid supply line having first and second ends, said first end of said warm liquid supply line being connected to said cold side of said defrost heat exchanger and said second end of said warm liquid supply line being connected to said refrigerated space heat exchanger;

wherein when a defrost cycle is operated, coolant from the secondary refrigeration system flows through said cold side of said defrost heat exchanger, is heated by the liquid refrigerant flowing through said hot side of said defrost heat exchanger, and then is transported to said refrigerated space heat exchanger to melt any frost formed on said refrigerated space heat exchanger.

11. The refrigeration system of claim 10, wherein said coolant supply line includes a diverter valve which can be opened or closed to selectively control the supply of coolant to said defrost heat exchanger.

12. The refrigeration system of claim 10, wherein said warm liquid supply line includes a warm liquid supply valve which can be opened or closed to selectively control the supply of warm coolant to said refrigerated space heat exchanger.

13. The refrigeration system of claim 10, wherein said secondary refrigeration loop includes a coolant shut-off valve positioned between said chiller and said refrigerated space heat exchanger for stopping the flow of coolant to said refrigerated space heat exchanger during the defrost cycle.

14. The refrigeration system of claim 10, further comprising control means for controlling the initiation and termination of the defrost cycle.

15. The refrigeration system of claim 14, wherein said control means comprises a microprocessor which automatically initiates and terminates the defrost cycle according to a pre-programmed schedule.

16. The refrigeration system of claim 10, wherein said defrost heat exchanger is a plate heat exchanger.

17. A method for warming coolant for warm liquid defrost in a secondary coolant refrigeration system comprising a primary refrigeration loop including a compressor, a condenser, a receiver and the first side of a chiller, and a secondary refrigeration loop including a pump, the second side of the chiller and a refrigerated space heat exchanger, said method comprising the steps of:

providing a defrost heat exchanger having a hot side and a cold side;

transporting high temperature liquid refrigerant from the receiver through the hot side of the defrost heat exchanger while simultaneously transporting low temperature coolant from the pump through the cold side of the defrost heat exchanger such that the coolant is heated by the liquid refrigerant; and transporting the heated coolant from the cold side of the defrost heat exchanger to the refrigerated space heat exchanger to melt any frost formed on the refrigerated space heat exchanger.

18. The method of claim 17, wherein the coolant is transported from the pump to the defrost heat exchanger with a coolant supply line.

19. The method of claim 18, further comprising the step of selectively opening and closing a diverter valve provided in the coolant supply line to selectively control the supply of coolant to the defrost heat exchanger.

20. The method of claim 17, wherein the coolant is transported from the defrost heat exchanger to the refrigerated space heat exchanger with a warm liquid supply line.

21. The method of claim 20, further comprising the step of selectively opening and closing a warm liquid supply valve provided in the warm liquid supply line to selectively control the supply of warm coolant to the refrigerated space heat exchanger.

22. The method of claim 17, further comprising the step of selectively opening and closing a coolant shut-off valve positioned between the chiller and the refrigerated space heat exchanger to selectively control the supply of coolant to the refrigerated space heat exchanger during the defrost cycle.

23. The method of claim 17, wherein the secondary refrigeration system further includes control means for controlling the initiation and termination of the defrost cycle.

24. The method of claim 23, wherein the control means comprises a microprocessor which automatically initiates and terminates the defrost cycle according to a pre-programmed schedule.

25. The method of claim 17, wherein the defrost heat exchanger is a plate heat exchanger.

* * * * *